US005490643A

United States Patent [19]

Jano et al.

[11] Patent Number: 5,490,643

[45] Date of Patent: Feb. 13, 1996

[54] OPTICAL DEVICE FOR THE UNAMBIGUOUS MEASUREMENT OF THE ROLL ANGLE OF A PROJECTILE

[75] Inventors: Patrice Jano, Seine Port; Sylvie Rat, Paris, both of France

[73] Assignee: Thomson-CSF, Paris, France

[21] Appl. No.: 255,994

[22] Filed: Jun. 8, 1994

[30] Foreign Application Priority Data

Jun. 8, 1993 [FR] France ..... 93 06833

[51] Int. Cl.[6] ..... F41G 7/00

[52] U.S. Cl. ..... 244/3.11

[58] Field of Search ..... 244/3.11, 3.13, 244/3.16; 356/139.03

[56] References Cited

U.S. PATENT DOCUMENTS 4,072,281 2/1978 Miller, Jr. et al. .

4,097,007 6/1978 Fagan et al. ..... 244/3.11

FOREIGN PATENT DOCUMENTS 0485292 5/1992 European Pat. Off. .

2650139 5/1978 Germany .

8501616 1/1987 Netherlands .

*Primary Examiner*—Mark Hellner

*Attorney, Agent, or Firm*—Oblon, Spivak, McClelland, Maier, & Neustadt

[57] ABSTRACT

This optical device has, in the rear of the projectile, a retro-reflector fitted out with a polarizer and, at the projectile firing station, a light source whose beam illuminates the rear of the projectile, and a light flux analyzer deducing the roll angle of the projectile from the direction of polarization of the light flux reflected by this projectile, wherein the polarizer is a polarizer with refraction index discontinuity positioned on the rear of the projectile, before the retro-reflector, with an angle of inclination between the direction normal to its plane of index variation and the longitudinal axis of the projectile chosen to be greater than the Brewster angle, and wherein the light source is offset laterally with respect to firing axis of the projectile, these two measurements giving rise to a modulation of intensity of the reflected light beam as a function of the roll angle plus or minus $2\pi$, giving, to two successive maximum values of the signal of the analyzer, different amplitudes that enable them to be differentiated and therefore make it possible to remove the ambiguity of $\pi$ resulting from the measurement of the direction of polarization. FIG. 1.

5 Claims, 4 Drawing Sheets

ANGLE OF INCIDENCE (DEGREES)

OPTICAL DEVICE FOR THE UNAMBIGUOUS MEASUREMENT OF THE ROLL ANGLE OF A PROJECTILE

BACKGROUND OF THE INVENTION

1. Field of the Invention

The present invention relates to the measurement of the roll angle of a projectile.

To guide a projectile or a missile in flight, it should be possible to take appropriate action on its steering devices, namely its rudders, thrustors, gas jets etc., and therefore it is necessary to know their orientation with respect to a plane passing through a horizontal or vertical axis and the longitudinal axis of the projectile or missile, namely the roll angle.

2. Description of the Prior Art

The roll angle can be obtained by a measurement on board the projectile or missile, for example by an inertial measurement, but this necessitates the installation of sophisticated equipment on board the projectile and gives rise to a variety of drawbacks:

- penalties in terms of weight and volume;
- fragility of the measuring device which does not withstand very high rates of acceleration;
- time needed for starting up;
- high cost for an expendable device;
- the need for preventive maintenance;
- the need to transmit the information to the firing station if it is on the ground.

There are known ways, described notably in the American patent US-A-4.072.281 for making a measurement, from the ground, of the roll angle of a projectile or missile optically by fitting out the rear of the projectile with a retro-reflector preceded by a polarizer, illuminating the rear of the projectile from the ground and making a measurement on the ground, using a light analyzer, of the direction of polarization of the beam reflected by the rear of the projectile.

By virtue of its principle, this optical measurement of the roll angle of a projectile has an ambiguity of $\pi$. There are known ways of removing this ambiguity that either rely on prior knowledge of the initial roll angle or consist of the addition, to the rear of the projectile, of an additional optical device such as a reflecting dihedron that is unmasked with respect to the illumination source only once every roll rotation.

Prior knowledge of the initial roll angle is not always available, especially when the projectile is a projectile launched by a gun.

The addition of a supplementary optical device increases the cost of the expendable parts placed on board the projectile or the missile.

SUMMARY OF THE INVENTION

The present invention is aimed at an optical measurement, without ambiguity, of the roll angle of a projectile, requiring a minimum of elements placed on board the projectile or the missile.

An object of the invention is an optical device for the measurement, without ambiguity, of the roll angle of a projectile launched by launching means located in a firing station. This device has, in the rear of the projectile, a retro-reflector fitted out with a polarizer and, in the firing station, a light source that is offset laterally with respect to the axis of firing of the projectile and whose beam illuminates the rear of the projectile, and a light flux analyzer operating on the light flux reflected by the rear of the projectile, wherein the polarizer is a polarizer with refraction index discontinuity positioned on the rear of the projectile, before the retro-reflector, with an angle of inclination between the direction normal to its plane of index variation and the longitudinal axis of the projectile chosen to be greater than the Brewster angle, in a range of monotonic variation of the transmission coefficient. The lateral offset of the light source with respect to firing axis of the projectile causes the angle of incidence of the light beam on the polarizer to vary around the value of the angle of inclination of the polarizer as a function of the roll angle of the projectile. This prompts a variation of the transmission coefficient of the polarizer leading to a modulation of intensity of the light beam reflected by the rear of the projectile whose period corresponds to a roll rotation. When the light flux reflected by the rear of the projectile has a direction of polarization in the plane defined by the firing axis and the collimation line of the light source, the transmission coefficient of the polarizer goes through a maximum level and a minimum level that makes it possible to distinguish between two possible roll angle values. Indeed, it is then enough to design the analyzer so that its detected signal goes through a maximum when the direction of polarization of the beam reflected by the projectile goes through the plane defined by the firing axis and the collimation line of the light source, for this maximum will take two different values for the two possible values of roll angle.

The polarizer with refraction index discontinuity is advantageously constituted by one or more superimposed plates made of a transparent material with an index greater than 1. It may also be a polarizer with dielectric layers or a Glan-Thompson polarizer or prism.

BRIEF DESCRIPTION OF THE DRAWINGS

Other features and advantages of the invention shall appear from the following description of an embodiment given by way of an example. This description will be made with reference to the appended drawing, of which.

MORE DETAILED DESCRIPTION

Figure 1:
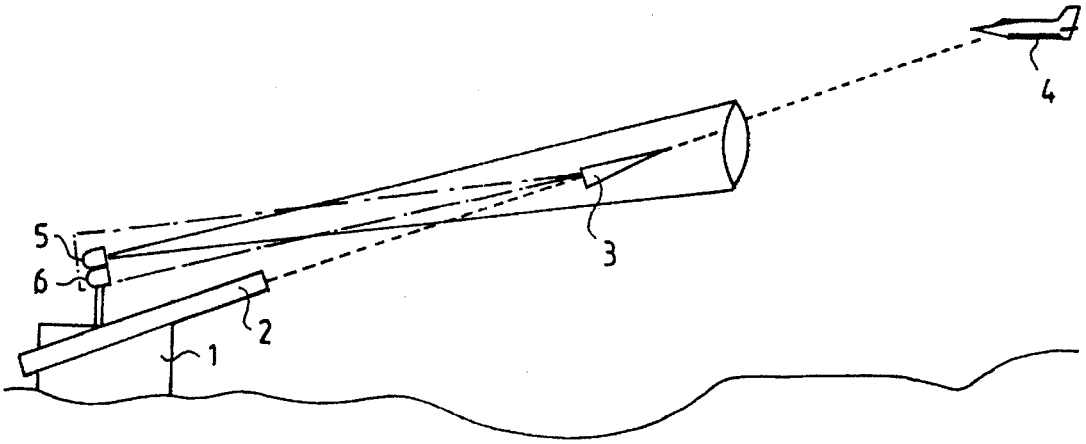
- FIG. 1 shows an general drawing of a guided projectile firing station fitted out with a roll measurement optical device.

FIG. 1 shows a firing station 1 equipped with a gun 2 that has just launched a guided projectile towards a target 4. The optical device for measuring the roll angle of the guided projectile 3 comprises, at the firing station 1, a light source 5 constituted by a laser aimed at the rear of the guided projectile 3 and a light flux analyzer 6 that is mechanically coupled to the light source 5 and analyzes the direction of polarization of the light flux reflected by the rear of the guided projectile 3 in order to deduce its roll angle therefrom at all times.

The laser constituting the light source 5 is aimed at the guided projectile 3 by a standard tracking system. Furthermore, it works in pulses to transmit steering commands to the guided projectile 3.

Figure 2:
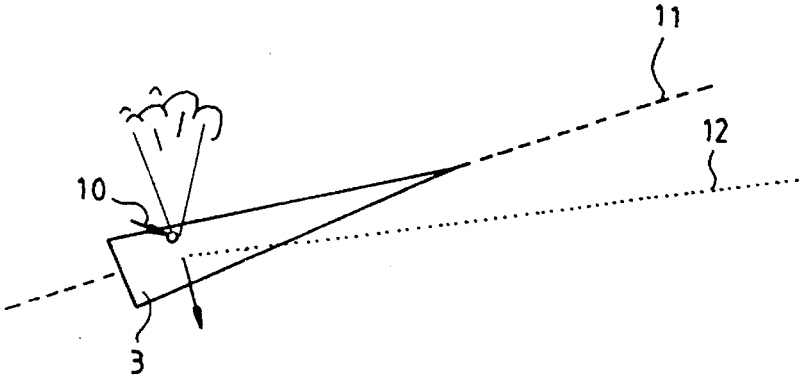
- FIG. 2 shows a schematic view of a guided projectile with its trajectory-changing means.

The guided projectile 3 is ejected from the gun 2 with a rotational roll motion. As shown in FIG. 2, it has at least one lateral thrustor constituted by a lateral gas ejection hole 10 which may or may not be placed at the center of gravity and is coupled to a gas generator on board the projectile by means of a valve that is opened by pulses under the control of a steering device that responds to the commands transmitted by the pulses from the laser. On being commanded to do so, the valve, for a very brief period, lets out a blast of propulsion gas through the lateral ejection hole. This brings about a lateral shift of the projectile 3 which is deflected in the direction in which the thrust of the blast of gas has taken place and leaves its former path 11 to take a new path 12. Naturally, in order that the lateral thrustor or thrustors may be used appropriately, the roll angle of the projectile 3 must be known at all times.

Figure 3:
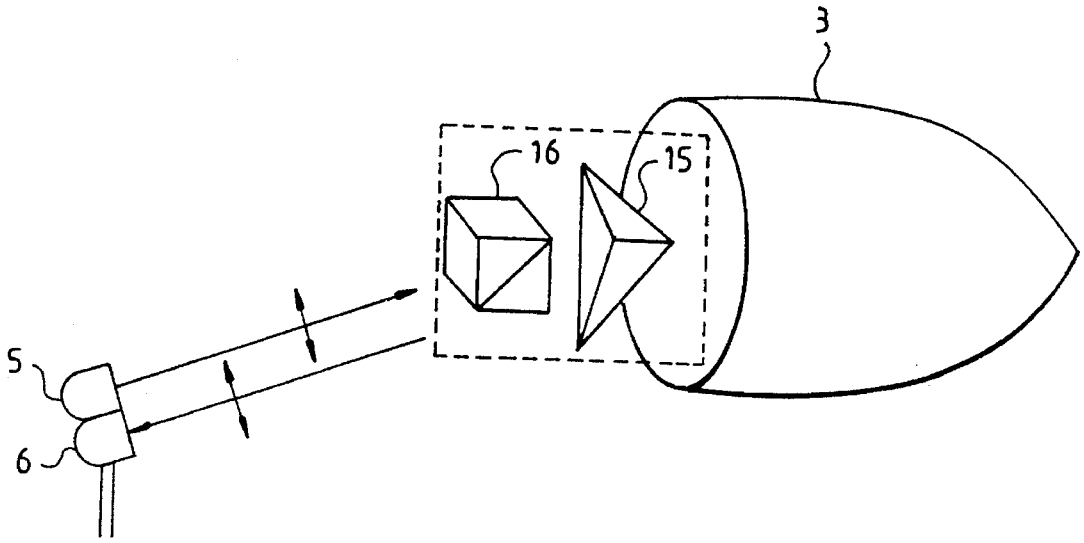
- FIG. 3 shows a schematic view of the optical elements fitted into a projectile for the implementation of an optical measurement of the roll angle.

For this purpose, the guided projectile 3 is equipped on its rear face, as can be seen in FIG. 3, with a retro-reflector 15 preceded by a polarizer 16.

As shown in the figure, the retro-reflector 15 may be a reflective trihedron formed by means of a cube corner. It is an optical invariant that sends back the received light beams in their directions of incidence. All that the polarizer 16, which shall be described in detail further below, lets through from a light beam is the rectilinear polarization component parallel to its own direction of polarization which is related to the roll angle of the projectile.

The light source 5 generating the incident beam may be rectilinearly polarized.

All that the polarizer 16, which is assumed to be perfect, lets through from the beam is the component parallel to its direction of polarization. In the case of the planned use, where the retro-reflector is uniformly illuminated, this component gets reflected on the retroreflector without changing its direction of polarization and then goes through the polarizer again in the direction of the incident light flux independently of the attitude of the projectile according to other angles, namely the pitch and yaw angles. The analyzer 6 which is, in this case, a simple optical receiver sensitive to the intensity of the light flux received, detects the intensity of this light flux component returned by the projectile 3 and reveals its relationship of variation in intensity which is a cosine squared function of the roll angle (Malus's law).

The light source 5 generating the incident beam may be also be non-polarized or circularly polarized. All that the polarizer 16, which is assumed to be perfect, lets through from the beam is the component parallel to its direction of polarization which gets reflected on the retro-reflector without changing its direction of polarization and then goes through the polarizer again in the direction of the incident light flux independently of the attitude of the projectile according to the other angles, namely the pitch and yaw angles. The analyzer 6 comprises, in this case, an analyzer positioned as a polarization analyzer before an optical receiver sensitive to the intensity of the light flux received. It detects the direction of polarization of the light flux returned by the projectile 3 and generates a signal whose level varies as a cosine squared function of the roll angle (Malus's law).

In any case, a detection of the roll angle based on the simple observation of the direction of polarization of the beam reflected by the projectile 3 leads to a measurement signal that is a cosine squared function of the roll angle enabling the value of the roll angle to be obtained only with an uncertainty of plus or minus $\pi$.

It is proposed to remove the ambiguity of $\pi$ in the measurement by giving different amplitudes to the two maximum values of the signal detected by the analyzer for two complementary particular values, plus or minus $\pi$, of the roll angle. To do this, a modulation of intensity of light flux depending on the roll angle, plus or minus $2\pi$, is added to the variation in intensity of the light flux detected in the analyzer owing to the change in direction of polarization of the beam reflected by the projectile 3.

To carry out this modulation of intensity, a polarizer with refraction index discontinuity is chosen. This polarizer with refraction index discontinuity is positioned on the rear face of the projectile 3 so that the direction normal to its plane of refraction index variation and the longitudinal axis of the projectile 3 form an angle of inclination greater than the value of the Brewster angle, and the light source 1 and the analyzer 6 are offset laterally so that the angle of incidence of the beam of the light source 1 on the plane of refraction index variation of the polarizer varies slightly on either side of the angle of inclination as a function of the roll angle. Thus, for the two values, plus or minus $\pi$, of the roll angle for which the reflected light flux has a direction of polarization in the plane defined by the firing axis and the collimation line of the light source, the transmission coefficient of the polarizer has two distinct values, one greater than the other. If the direction of polarization of the light source or that of the polarizer of the analyzer are adjusted to obtain a maximum of the measurement signal for this direction of polarization, then this maximum, owing to the two possible values of the transmission coefficient, will take two distinct values for the two values, plus or minus $\pi$, of the roll angle corresponding to this direction of polarization, thus making it possible to remove the ambiguity of $\pi$.

Figure 4:
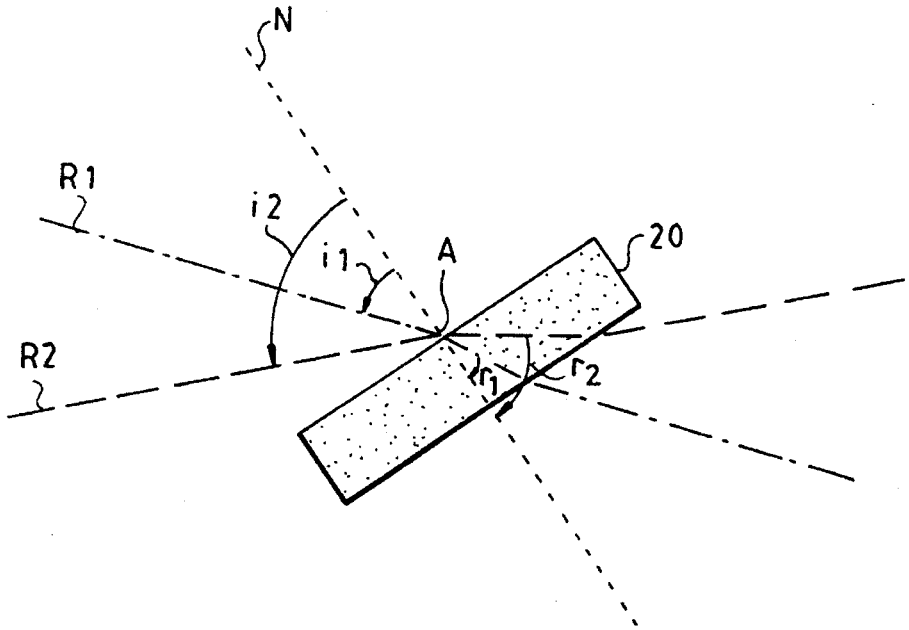
- FIG. 4 shows the deflection of light rays by a polarizing plate.

A polarizer with refraction index discontinuity can be represented schematically, as shown in FIG. 4, by a polarizing plate 20. This polarizing plate reflects the component perpendicular to the plane of incidence defined by the normal to the surface of the plate and the direction of the incident wave, and lets through the component parallel to the plane of incidence. FIG. 4 shows the transmission of the component parallel to the plane of incidence of two rays $R_1$, $R_2$ falling on the polarizing plate 20 at a point A. One of the rays $R_1$ forms an angle of incidence $i_1$ with the normal N at the point A, and has its polarization component parallel to the plane of incidence that goes through the plate 20 at an angle of refraction $r_1$. The other ray $R_2$ forms an angle of incidence $i_2$ with the normal N at the point A, and has its polarization component parallel to the plane of incidence that goes through the plate 20 at an angle of refraction $r_2$.

It is known, according to the laws of Fresnel and Descartes, that the factors of reflection and transmission of a wave polarized by a surface depend on the angle of incidence. In particular, the factor of transmission in intensity T of the component with polarization parallel to the plane of incidence at the crossing of one face of the material is equal to:

$$T=\left[\frac{2\cos i\times\sin r}{\sin(i+r)\times\cos(i-r)}\right]^2$$

with sin i=n sin r i being the angle of incidence, r the angle of refraction and n the index of the material of the polarizing plate.

Figure 5:
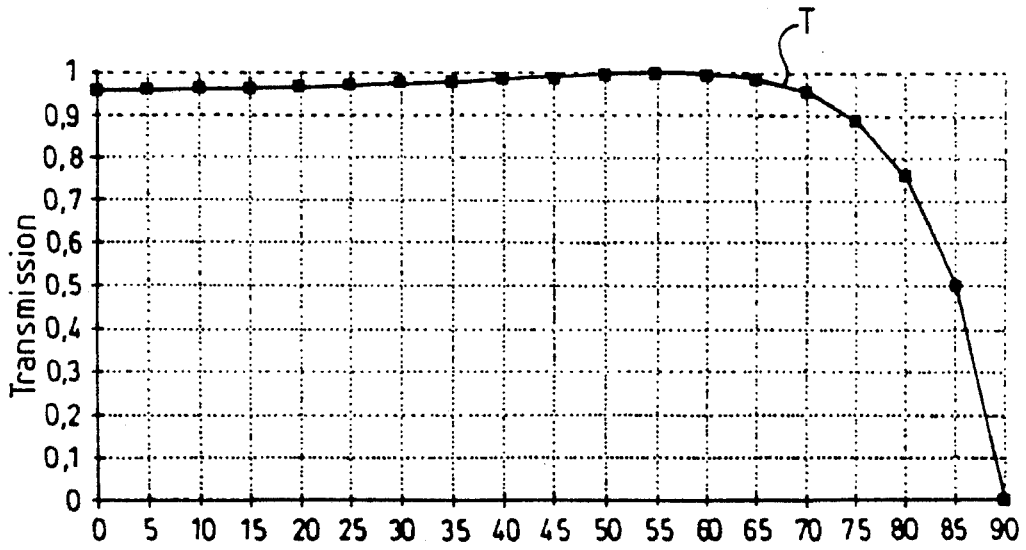
- FIGS. 5, 6 and 7 show the variations, as a function of the angle of incidence, of the factors of transmission in intensity of different plate polarizers.

FIG. 5 shows the variation of the factor of transmission T given by the foregoing formula for a polarizing plate made of a transparent material with an index n=1.5, placed in open air. It is noted that the factor of transmission T remains close to one, increasing with the value of incidence up to a maximum value reached for a value of the angle of incidence called the Brewster angle, close herein to 57°, and then falls monotonically to get cancelled out for an angle of incidence equal to 90°. It is observed, and this is the major point here, that in a range centered on an angle of incidence of 70°, the factor of transmission T has substantial variations while at the same time keeping high values. Taking this range of operation, it is possible to achieve a modulation of intensity without in any way thereby absorbing an excess of light energy.

Figure 6:
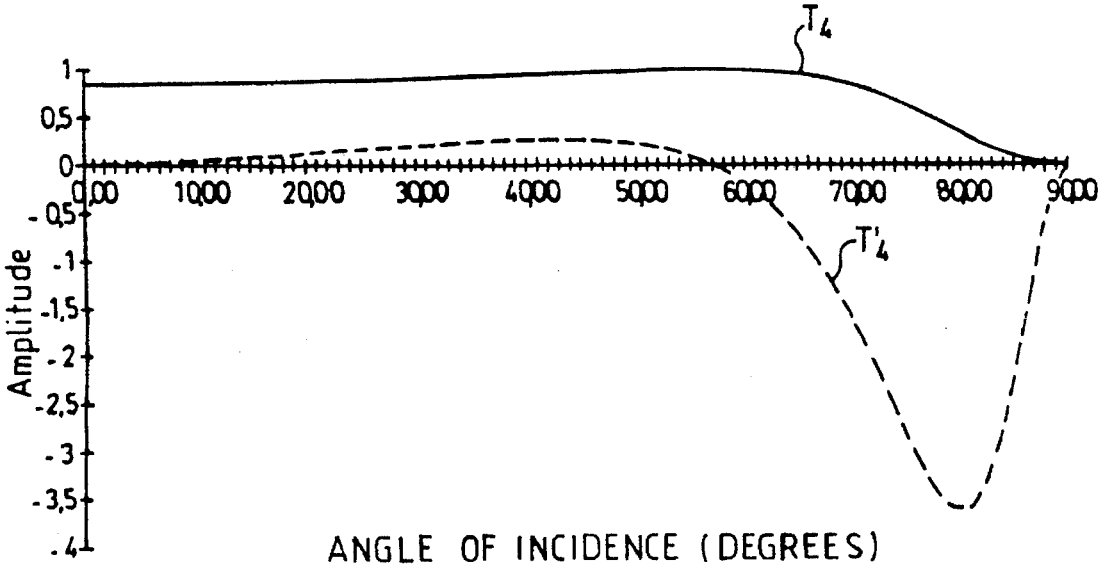

FIG. 6 illustrates the variation of the factor of transmission $T_4$ shown in a solid line and its derivative $T'_4$ shown in dashes in the case of a polarizing plate with an index n=1.5 subject to crossings to and fro, giving four face crossings which is the exemplary application particularly concerned by the measurement of the roll angle by retro-reflection on a trihedron through a polarizing plate.

By choosing two slightly different angles of incidence around 75°, for example 72° and 78°, two very different values 0.77 and 0.46 are obtained for the transmission coefficient $T_4$, giving a modulation of intensity m=(0.77–0.46)/0.64=0.48 in relation to a mean angle of incidence im=(72+78)/2=75° corresponding to a mean factor of transmission Tm=0.64.

Naturally, it is possible to optimize the contrast of the modulation and the mean factor of transmission by bringing into play the number of plates of the polarizer, the index n of its material, the mean angle of incidence and the variation of angle of incidence.

Figure 7:
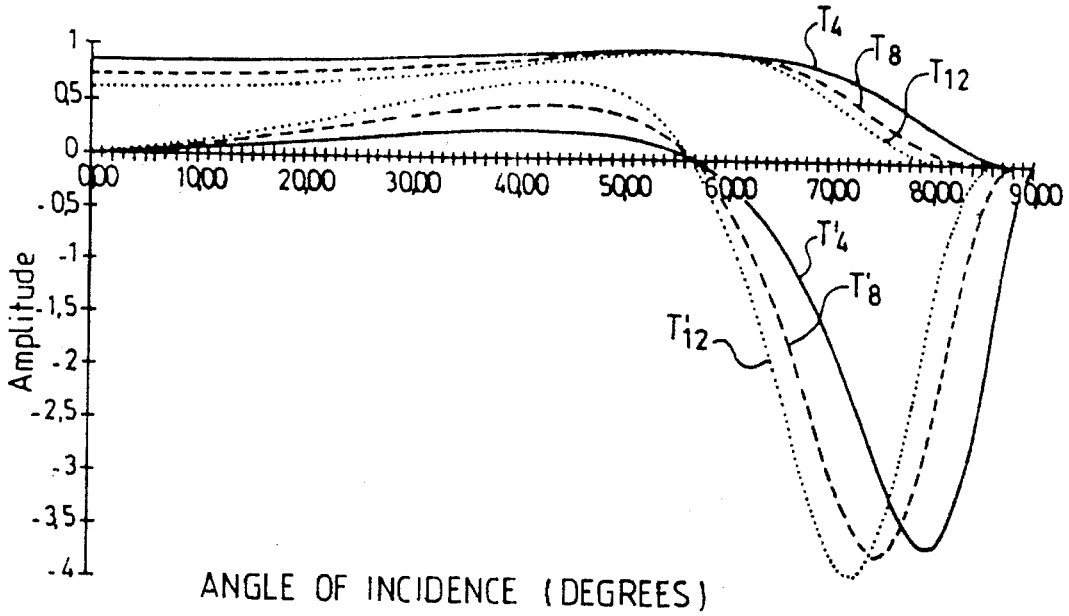

FIG. 7 shows the variations, as a function of the angle of incidence, of the different factors of transmission $T_4$, $T_8$, $T_{12}$ and their derivatives $T'_4$, $T'_8$, $T'_{12}$ corresponding respectively to polarizers with one, two or three plates having an index n=1.5. It is observed that, for a polarizer with two plates corresponding to the curves $T_8$ to $T'_8$, it is advantageous to choose a mean angle of incidence of 71° corresponding to a mean factor of transmission of 0.65 for there is obtained, for a difference in angle of incidence of 6°, a rate of modulation in intensity of 0.5. Similarly, in the case of a polarizer with three plates corresponding to the curves $T_{12}$ and $T'_{12}$, it is seen that it is advantageous to choose a mean angle of incidence of 68° corresponding to a mean factor of transmission of 0.71 since a rate of modulation in intensity of 0.45 is obtained for a difference in angle of incidence of 6°.

In order to obtain, in practice, a modulation of intensity of the light beam reflected by the projectile as a function of the roll angle, the plate or plates of the polarizer are positioned on the rear of the projectile with an angle of inclination corresponding to the mean angle of incidence chosen, and the light source and the analyzer are offset laterally with respect to the firing axis to obtain, at mean distance, an offset angle of the order of three degrees. For example, the light source and the analyzer can be offset laterally by 25 meters with respect to the firing station, thus making it possible to obtain an angle of offset of three degrees when the projectile is aimed at a distance of 500 meters.

Figure 8:
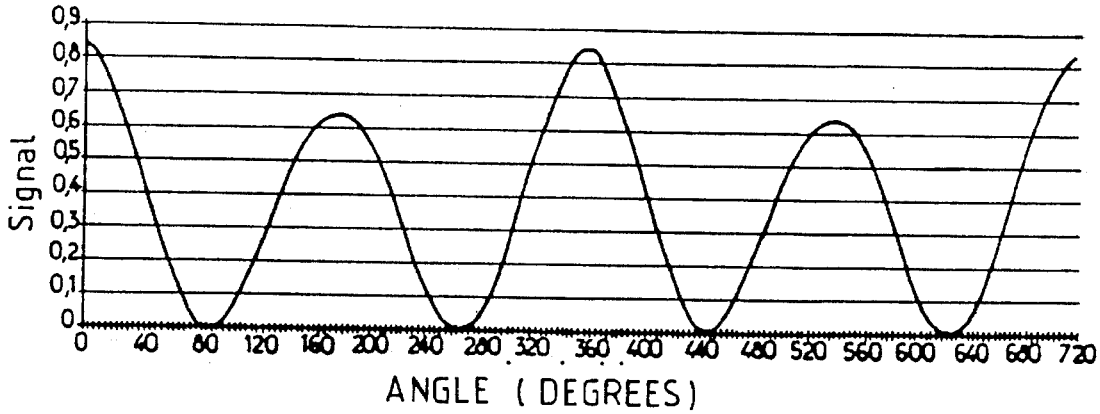
- FIGS. 8 and 9 show forms of the roll angle measuring signal that can be obtained with the device according to the invention.
Figure 9:
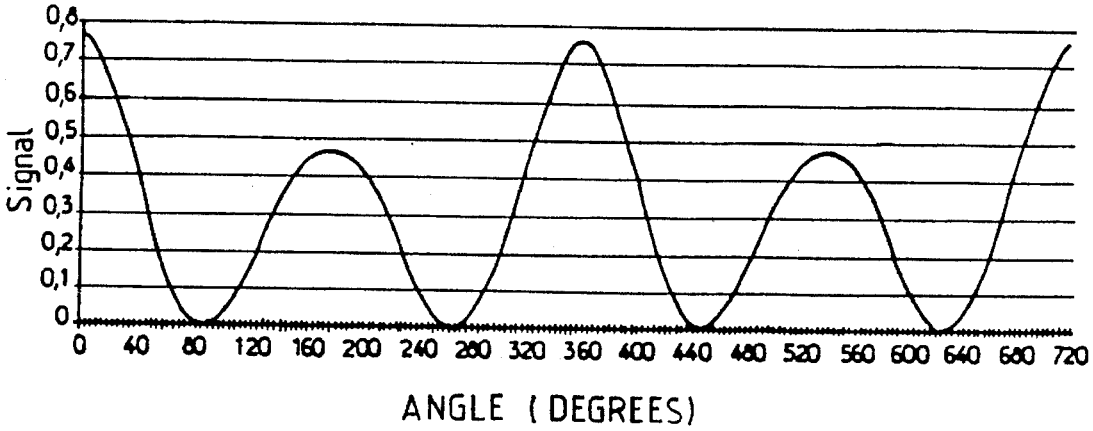

Once this modulation of intensity is obtained, it is seen to it that its maximum value and its minimum value (which occur when the direction normal to the plates of the polarizer goes through the plane defined by the collimation line and the firing axis, i.e. when the direction of polarization of the reflected beam goes through this plane) coincide with the maximum values of the measurement signal of the analyzer. This is obtained by a simple adjusting of the direction of polarization of the light source or of the polarizer of the analyzer parallel to this plane. The result thereof, at output of the analyzer, is a measurement signal whose level varies as a function of the roll angle of the projectile in accordance with the curve of FIG. 8 if the polarizer is one-plate polarizer or with the curve of FIG. 9 is the polarizer is a three-plate polarizer.

The marked difference in amplitude between the two maximum values of the measurement signal for one and the same direction of polarization of the beam reflected by the projectile but for two opposite values of roll angle makes it easy to remove the ambiguity of $\pi$ when the projectile is a projectile rotating on itself, which is the case where the ambiguity raises the greatest problems for this ambiguity cannot easily be removed on the basis of knowledge of the initial attitude of the projectile. Indeed, it is enough to identify the greatest or the smallest of two consecutive maximum values. A known value of roll angle plus or minus $2\pi$ can then be assigned to it. This can be done, for example, by fitting out the output of the analyzer with a relative maximum detector followed by a level comparator.

In practice, this removal of ambiguity based on the difference in level between two consecutive maximum values in the measurement signal owing to the modulation of intensity is done when the light beam gets locked into the projectile, at a distance of the order of 500 meters. For, below this distance, the modulation rate is higher but the tracking of the projectile is difficult to ensure, especially if it is fast and, beyond this distance, the modulation rate diminishes since the angle of offset at which the light source is aimed at the projectile gets smaller as the projectile moves away.

Once the ambiguity of $\pi$ has been removed, the phase is kept in the usual way, for example by means of a predictive filtering of the measurement signal centered on twice the roll rotational frequency of the projectile.

The only polarizers with refraction index discontinuity mentioned in the embodiments described are plate polarizers but it is clear that other types of polarizers with refraction index discontinuity such as dielectric layer polarizers or Glan-Thompson polarizers could also be used.

What is claimed is:

1. An optical device for the measurement, without ambiguity, of the roll angle of a projectile launched by launching means located in a firing station, said device comprising, in the rear of the projectile, a retroreflector fitted out with a polarizer and, in the firing station, a light source that is offset laterally with respect to the firing axis of the projectile and whose beam illuminates the rear of the projectile, and a light flux analyzer operating on the light flux reflected by the rear of the projectile, wherein said polarizer is a polarizer with refraction index discontinuity positioned on the rear of the projectile, before the retroreflector, with an angle of inclination between the direction normal to its plane of index variation and the longitudinal axis of the projectile chosen to be greater than the Brewster angle in a range of monotonic variation of a transmission coefficient of the polarizer, the lateral offset of the light source with respect to firing axis of the projectile causing the angle of incidence of the light beam on the polarizer to vary around the value of the angle of inclination of the polarizer as a function of the roll angle of the projectile adding to the change in direction of polarization of the light beam returned by the projectile depending on the roll angle plus or minus $\pi$, a modulation of intensity depending on the roll angle plus or minus $2\pi$, wherein the light source and the light flux analyzer are set so as to give a signal of measurement of the direction of polarization whose maximum values, corresponding to two values separated from the roll angle by $\pi$, coincide with the maximum and the minimum of the modulation of intensity, and wherein the light flux analyzer comprises means to distinguish the two possible maximum values of its measurement signal by their different relative levels.

2. A device according to claim 1, wherein said polarizer with refraction index discontinuity is a transparent plate polarizer.

3. A device according to claim 1, wherein said polarizer with refraction index discontinuity is formed by the superimposition of several transparent plates.

4. A device according to claim 1, wherein said polarizer with refraction index discontinuity is a polarizer with several dielectric layers.

5. A device according to claim 1, wherein said polarizer with refraction index discontinuity is a Glan-Thompson polarizer.

* * * * *